US009435187B2

(12) United States Patent
Hohl et al.

(10) Patent No.: US 9,435,187 B2
(45) Date of Patent: Sep. 6, 2016

(54) METHOD TO PREDICT, ILLUSTRATE, AND SELECT DRILLING PARAMETERS TO AVOID SEVERE LATERAL VIBRATIONS

(71) Applicants: Andreas Hohl, Hannover (DE); Bernhard Meyer-Heye, Bremen (DE); Hanno Reckmann, Nienhagen (DE)

(72) Inventors: Andreas Hohl, Hannover (DE); Bernhard Meyer-Heye, Bremen (DE); Hanno Reckmann, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 409 days.

(21) Appl. No.: 14/032,951

(22) Filed: Sep. 20, 2013

(65) Prior Publication Data

US 2015/0088468 A1 Mar. 26, 2015

(51) Int. Cl.

| | |
|---|---|
| ***G06G 7/48*** | (2006.01) |
| ***E21B 44/00*** | (2006.01) |
| ***E21B 47/00*** | (2012.01) |
| ***E21B 41/00*** | (2006.01) |

(52) U.S. Cl.

CPC ..... *E21B 44/00* (2013.01); *E21B 41/00* (2013.01); *E21B 47/00* (2013.01)

(58) Field of Classification Search

CPC ..... E21B 7/00; E21B 44/00; E21B 25/16; E21B 47/00; E21B 47/02; E21B 47/024; E21B 7/06; E21B 44/02; E21B 7/04; E21B 47/09; E21B 44/06; G05B 15/00; G06F 7/60; G06F 19/00; G01V 1/40; G06G 7/48; G06T 1/00

See application file for complete search history.

(56) References Cited

U.S. PATENT DOCUMENTS

| | | | | |
|---|---|---|---|---|
| 5,321,981 | A | 6/1994 | Macpherson | |
| 6,021,377 | A | 2/2000 | Dubinsky et al. | |
| 6,206,108 | B1 * | 3/2001 | MacDonald | E21B 44/00 175/24 |
| 6,443,228 | B1 * | 9/2002 | Aronstam | E21B 47/12 166/250.11 |
| 7,857,047 | B2 | 12/2010 | Remmert et al. | |
| 8,014,987 | B2 | 9/2011 | Pabon et al. | |
| 8,180,614 | B2 | 5/2012 | Pabon et al. | |

(Continued)

FOREIGN PATENT DOCUMENTS

WO 2013062409 A1 5/2013

OTHER PUBLICATIONS

Liu et al, "A New Analytical Model on Lateral Vibration and Impact of Drill String", The Twentieth International Offshore and Polar Engineering Conference, Jun. 20-25, 2010 , Beijing, China, The International Society of Offshore and Polar Engineers, 5 pages.

(Continued)

*Primary Examiner* — Kandasamy Thangavelu
(74) *Attorney, Agent, or Firm* — Cantor Colburn LLP

(57) ABSTRACT

A method for estimating drilling parameters for drilling a borehole in the earth includes: drilling the borehole with a drill string having a mud motor and a drill bit; constructing a mathematical model of a system including the drill string, the mud motor, and a borehole geometry; calculating a mud motor lateral excitation force imposed on the drill string by the mud motor for one or more combinations of drill string rotational speed and mud motor rotational speed; calculating lateral motion of the drill string and a force imposed on the drill string at positions along the drill string for the one or more of combinations using the model and the excitation force; selecting a range of combinations of drill string rotational speed and mud motor rotational speed that result in the force imposed upon the drill string being less than a threshold value; and displaying the range of combinations.

21 Claims, 6 Drawing Sheets

(56) References Cited

U.S. PATENT DOCUMENTS

| | | | | |
|---|---|---|---|---|
| 8,214,188 | B2 | 7/2012 | Bailey et al. | |
| 8,417,495 | B2 * | 4/2013 | Dashevskiy | E21B 44/00 175/45 |
| 2002/0120401 | A1 | 8/2002 | MacDonald et al. | |
| 2006/0021797 | A1 * | 2/2006 | Krueger | E21B 7/062 175/61 |
| 2009/0090555 | A1 * | 4/2009 | Boone | E21B 44/02 175/45 |
| 2009/0114445 | A1 * | 5/2009 | Dashevskiy | E21B 44/00 175/45 |
| 2010/0025109 | A1 * | 2/2010 | Deo | E21B 47/0002 175/24 |
| 2010/0032165 | A1 | 2/2010 | Bailey et al. | |
| 2010/0038137 | A1 * | 2/2010 | Morris | E21B 47/0002 175/45 |
| 2010/0163306 | A1 * | 7/2010 | Pabon | E21B 4/02 175/24 |
| 2010/0305864 | A1 * | 12/2010 | Gies | E21B 47/01 702/9 |
| 2011/0077924 | A1 | 3/2011 | Ertas et al. | |
| 2011/0153217 | A1 | 6/2011 | Rodney | |
| 2011/0155466 | A1 * | 6/2011 | Gibb | E21B 7/067 175/61 |
| 2011/0186353 | A1 | 8/2011 | Turner et al. | |
| 2012/0018218 | A1 * | 1/2012 | Rosenhauch | E21B 47/02 175/24 |
| 2012/0046869 | A1 * | 2/2012 | Propes | E21B 7/067 702/9 |
| 2012/0130693 | A1 | 5/2012 | Ertas et al. | |
| 2012/0222900 | A1 | 9/2012 | Rodney et al. | |
| 2012/0267169 | A1 * | 10/2012 | Schwefe | E21B 47/024 175/45 |
| 2013/0032401 | A1 * | 2/2013 | Edbury | E21B 7/06 175/24 |
| 2013/0032407 | A1 | 2/2013 | Edbury et al. | |
| 2013/0049981 | A1 | 2/2013 | MacPherson et al. | |
| 2013/0054203 | A1 | 2/2013 | Herbig et al. | |
| 2013/0092438 | A1 | 4/2013 | Turner et al. | |

OTHER PUBLICATIONS

WellDrill Analytical Software for Downhole Drilling Equipment, WellDrill Analytical Software APS Technology, May 7, 2013, http://www.aps-tech.com/products/vibration/welldrill-software.php, 2 pages.

Allen, "BHA Lateral Vibrations: Case Studies and Evaluation of Important Parameters", Society of Petroleum Engineers, SPE/IADC 16110, SPE/IADC Drilling Conference, Mar. 15-18, 1987, New Orleans, Louisiana, 5 pages.

Cobern et al., "Drilling Vibration Monitoring & Control System", APS Technology Inc, Jan. 1, 2013, from the website: http://www.aps-tech.com/papers/APS-DVMCS.pdf., 17 pages.

Drillstring Vibrations and Vibration Modeling Schlumberger, May 7, 2013, 4 pages, http://www.slb.com/~/media/Files/drilling/brochures/drilling_opt/drillstring_vib_br.pdf.

Bailey et al., "Managing Drilling Vibrations Through BHA Design Optimization", SPE Drilling & Completion, vol. 25, No. 4, Dec. 2010, pp. 458-471.

Notification of Transmittal of the International Search Report and the Written Opinion of the International Searching Authority; PCT/US2014/056066; Korean Intellectual Property Office; Mailed Dec. 17, 2014; 13 pages.

* cited by examiner

METHOD TO PREDICT, ILLUSTRATE, AND SELECT DRILLING PARAMETERS TO AVOID SEVERE LATERAL VIBRATIONS

BACKGROUND

Boreholes are drilled into geologic formations for various reasons such as hydrocarbon production, geothermal production, and carbon dioxide sequestration. These boreholes are typically drilled by a drill rig, which rotates a drill string with a drill bit on the end. In some cases a mud motor may be disposed in a bottomhole assembly near the end of the drill string in order to increase the rotational speed of the drill bit. The mud motor uses the energy of flowing drilling fluid or mud to operate the motor.

In general, several drilling parameters are used as inputs to the drill rig to drill a borehole. Examples of these parameters include rotational speed of the drill string, rotational speed of the mud motor, and drilling fluid flow rate. Unfortunately, due the length of the drill string and the dynamic loads imposed on it while drilling a borehole, the drill string may be subject to high lateral vibration levels. These vibration levels may cause equipment damage, such as by making contact with the borehole wall, and impede drilling. Hence, it would be well received in the drilling and geophysical exploration industries if a method would be developed to select drill parameters that would result in avoiding high lateral vibration levels as a borehole is being drilled.

BRIEF SUMMARY

Disclosed is a method for estimating drilling parameters of a drill rig for drilling a borehole in an earth material. The method includes drilling the borehole with the drilling rig in operable communication with a drill string having a mud motor and a drill bit, the drill rig being receptive to adjustable rotational speed of the drill string and adjustable rotational speed of the mud motor. The method further includes constructing a mathematical model of a system that includes the drill string, the mud motor, and a geometry of the borehole using a processor. The model includes dimensions, mass distribution, material density, and material stiffness. The method further includes calculating a mud motor lateral excitation force imposed on the drill string by the mud motor for one or more combinations of drill string rotational speed and mud motor rotational speed using the processor. The method further includes calculating, with the processor, lateral motion of the drill string and a force imposed on the drill string at a plurality of positions along the drill string for the one or more of combinations of drill string rotational speed and mud motor rotational speed using the mathematical model and the mud motor lateral excitation force. The method further includes selecting a range of combinations of drill string rotational speed and mud motor rotational speed that result in the force imposed upon the drill string being less than a threshold value using the processor and displaying the range of combinations to a user using a display.

Also disclosed is an apparatus for drilling a borehole in an earth material. The apparatus includes a drill string coupled to a drill bit configured to drill the borehole, a mud motor disposed at the drill string and configured to rotate the drill bit, and a drill rig in operable communication with the drill string and configured to operate the drill string to drill the borehole, the drill rig being receptive to adjustable rotational speed of the drill string and adjustable rotational speed of the mud motor. The apparatus further includes a processor configured to: receive a mathematical model of a system comprising the drill sting, the mud motor, and a geometry of the borehole, the model comprising dimensions, mass distribution, material density, and material stiffness; calculate a mud motor lateral excitation force imposed on the drill string by the mud motor for one or more of combinations of drilling parameters; calculate lateral motion of the drill string and a force imposed on the drill string at a plurality of positions along the drill string for the one or more combinations of drilling parameters using the mathematical model and the mud motor lateral excitation force; select a range of combinations of drilling parameters that result in the force imposed upon the drill string being less than a threshold value; and provide the range of combinations to a display. The apparatus further includes a display configured to receive the range of combinations from the processor and to display the range of combinations to a user.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed is a method for selecting drilling parameters that are applied to a drill string for drilling a borehole. By drilling the borehole with the selected drilling parameters, high lateral vibration levels of the drill string are avoided. The method includes calculating the lateral frequency or vibration response of the drill string based on the theoretical excitation frequency of a mud motor that assists in rotating a drill bit and potentially other force inducing components above or below the mud motor. Excitation frequencies are an outcome of specific combinations of drilling parameters. The excitation frequencies that result in high lateral vibration levels of the drill string are avoided by displaying to a drill operator those combinations of drilling parameters that result in avoiding the high lateral vibration levels or those combinations that result in the high lateral vibrations. The high lateral vibration levels can result in a high value of a force related parameter imposed on the drill string. Non-limiting embodiments of these forces include at least one of a lateral force, a tangential force, a torque, a bending moment, a stress and a strain.

Figure 1:
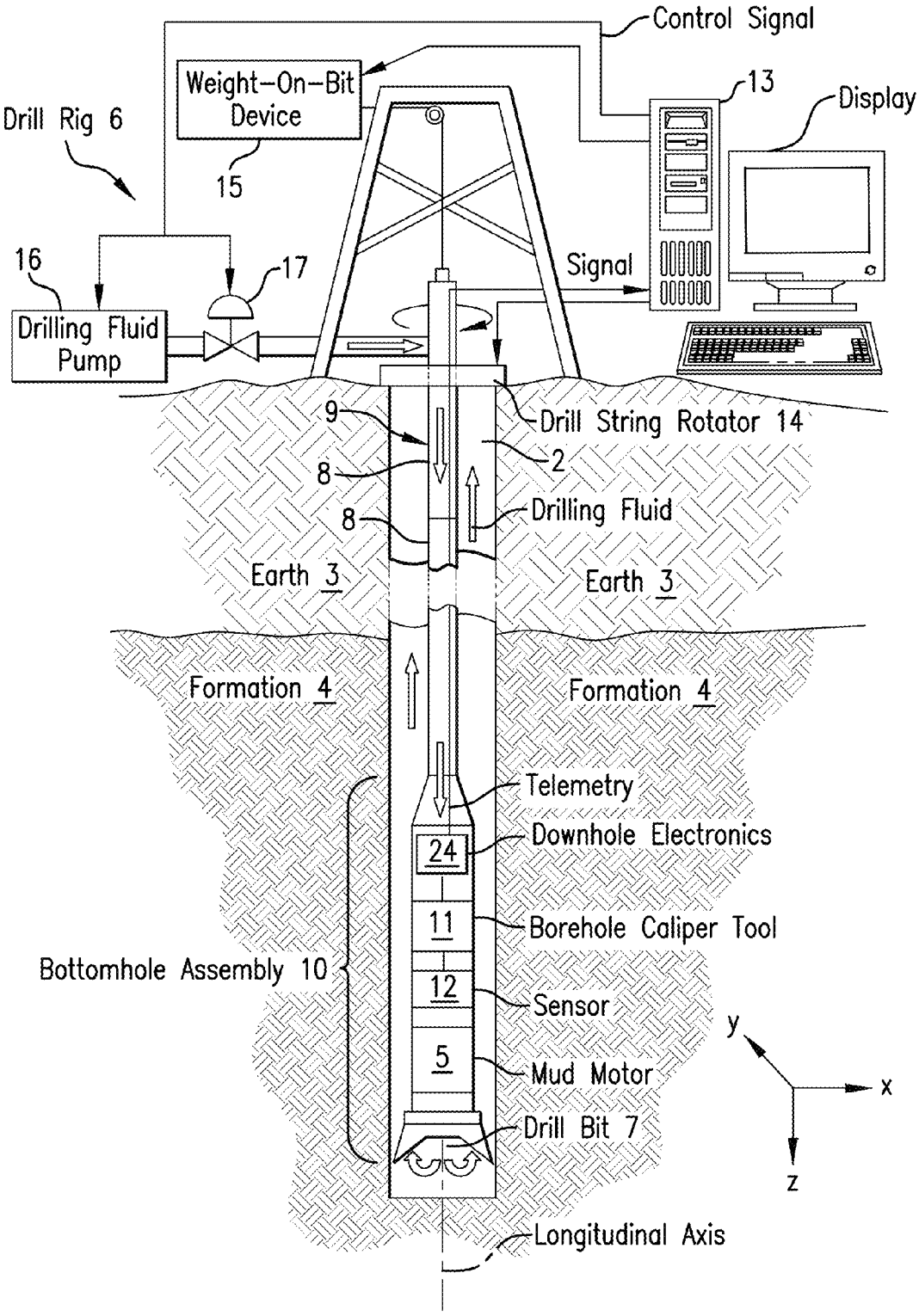
FIG. 1 illustrates a cross-sectional view of an exemplary embodiment of a drill string that includes a mud motor that is disposed in a borehole penetrating the earth.

Next, apparatus for implementing the drilling parameter selection method is discussed. FIG. 1 illustrates a cross-sectional view of an exemplary embodiment of a drill string 9 having a bottomhole assembly (BHA) 10 disposed in a borehole penetrating the earth 3. The earth 3 includes an earth formation 4, which may represent any subsurface material of interest that the borehole 2 may traverse. The drill string 9 in the embodiment of FIG. 1 is a string of coupled drill pipes 8. Disposed at the downhole end of the drill string 9 is the BHA 10. A drill bit 7, disposed at the distal end of the drill string 9, is configured to be rotated to drill the borehole 2. The BHA 10 may include the drill bit 7 as illustrated in FIG. 1 or it may be separate from the BHA 10. A drill rig 6 is configured to conduct drilling operations such as rotating the drill string 9 and thus the drill bit 7 in order to drill the borehole 2. In addition, the drill rig 6 is configured to pump drilling fluid also referred to "mud" through the drill string 9 in order to lubricate the drill bit 7 and flush cuttings from the borehole 2. The BHA includes a mud motor 5 that is configured to provide further rotational speed to the drill bit above the rotational speed of the drill string 9. The mud motor 5 is configured to convert some of the energy of the drill mud flowing internal to the drill string 9 into rotational energy for rotating the drill bit 7. Consequently, the drilling fluid flow rate correlates (e.g., may be proportional) to the mud motor speed such that a higher drilling fluid flow rate will result in a higher mud motor speed. Using a known correlation or an analytically or experimentally determined correlation, the mud motor speed can be determined from the drilling fluid flow rate.

Still referring to FIG. 1, a downhole caliper tool 11 is disposed in the BHA 10. The downhole caliper tool 11 is configured to measure the caliper (i.e., shape or diameter) of the borehole 2 as a function of depth to provide a caliper log. In one or more embodiments, the downhole caliper tool 11 is a multi-finger device configured to extend fingers radially to measure the diameter and shape of the borehole 2 at a plurality of locations about the longitudinal axis of the drill string 9. The number of measurement locations provides a measured shape for about 360° around the borehole 2. Alternatively, in one or more embodiments, the caliper tool 11 is an acoustic device configured to transmit acoustic waves and receive reflected acoustic waves in order to measure the borehole caliper. The borehole caliper log data may be input into a processor such as in downhole electronics 24 or a surface computer processing system 13, which may then process the data to provide a three-dimensional mathematical model of the borehole 2. Other borehole data may be entered into the model such as borehole wall stiffness or hardness or other physical parameters related to the borehole wall. This other data may be obtained by a downhole sensor 12 disposed at the drill string 9 or from data obtained from similar previously drilled boreholes. The downhole electronics 24 may further act as an interface with telemetry to transmit the caliper data or any processed data to the surface. Non-limiting examples of telemetry include mud-pulse telemetry and wired drill pipe that provide real time communication of data.

Still referring to FIG. 1, the drill rig 6 includes a drill string rotator 14 configured to apply torque and energy to the drill string 9 in order to rotate the drill string 9 for drilling the borehole 2. The drill rig 6 further includes a weight-on-bit device 15 for measuring and controlling the weight applied onto the drill bit 7 as well as rate of penetration. The drill rig 6 further includes a drilling fluid pump 16 configured to pump drilling fluid through the interior of the drill string 9 and a drilling fluid flow control valve 17 configured to control the flow rate of the drilling fluid being pumped. As an alternative, the speed of the drilling fluid pump 16 may be controlled to control the flow rate of the drilling fluid. The rotator 14, the device 15, the drilling fluid pump 16, and the flow control valve 17 are configured to be receptive to a control signal provided by a controller, which can be the surface computer processing system 13, in order to provide an output that corresponds to the control signal. For example, the rotator 14 can be adjusted to provide a selected torque and/or rotational speed to the drill string, the device 15 can be adjusted to provide a selected weight and or rate of penetration (ROP) that is applied onto or performed by the drill bit, and the drilling fluid pump 16 and/or the flow control valve 17 can be adjusted to provide a selected drilling fluid flow rate, which may be used to adjust the rotational speed of the mud motor 5. Various surface sensors (not shown) may be used to monitor these outputs and provide indication to an operator or user or input to the controller for feedback control, however, feedback control is not a requirement.

Figure 2:
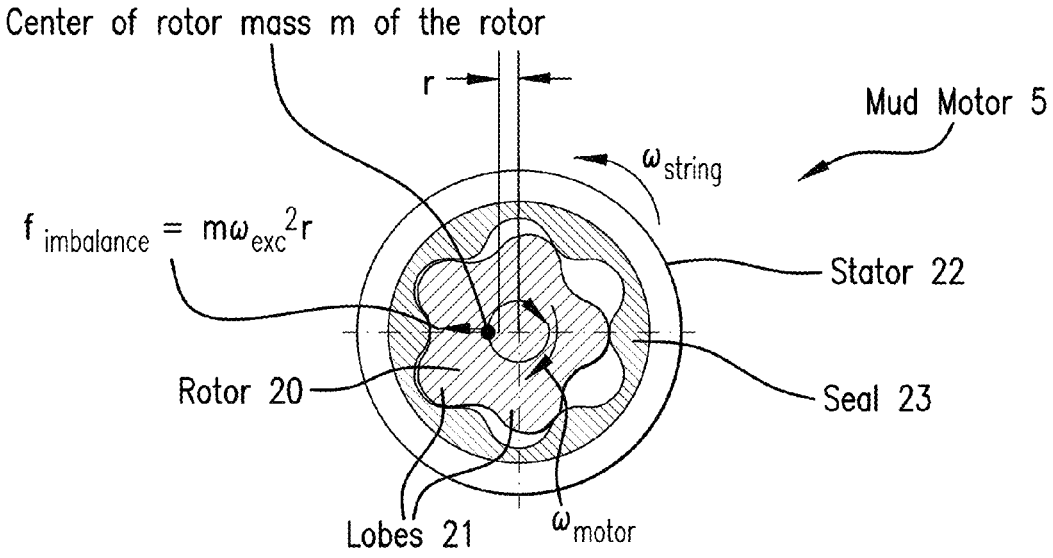
FIG. 2 depicts aspects of the mud motor.

FIG. 2 depicts aspects of the mud motor 5 in a top cross-sectional view. The mud motor 5 includes a rotor 20 having one or more lobes 21 and a stator 22. A seal 23 made up of a resilient material such as rubber is attached to the stator 22 and is configured to seal against the lobes 21 as the rotor 20 rotates. The lobes 21 are configured to rotate the rotor 20 upon interacting with the flow of drilling fluid between the rotor and the stator. It is noted that the rotor rotates in a direction that is opposite the direction of rotation of the mud motor and, thus, the drill bit. The lateral vibrations of the mud motor are due to the mass imbalance of the rotor. Every time a lobe engages the seal, the center of mass of the rotor moves eccentrically at a distance r from the tool center. This distance r may be referred as the eccentricity of the rotor. In the embodiment of FIG. 2, the number of lobes is five. Hence, there will be five imbalance force and vibration cycles for each 360° rotation of the mud motor.

Figure 3:
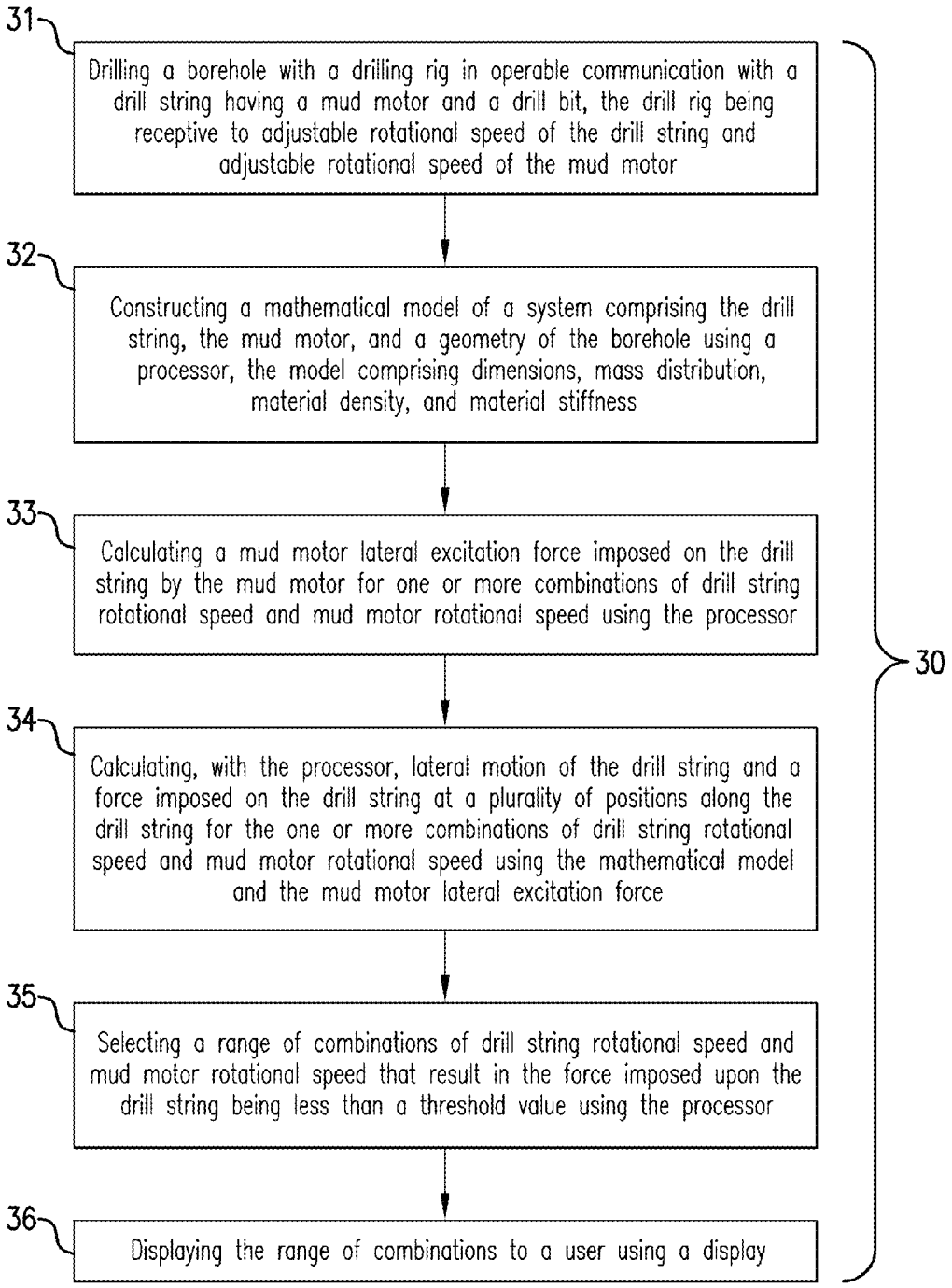
FIG. 3 is a flow chart for a method for estimating drilling parameters of a drill rig for drilling a borehole in an earth material.

Next, the drilling parameter selection method is discussed. This method may be implemented by a processor such as a processor in the downhole electronics 24 or the surface computer processing system 13. FIG. 3 is a flow chart for a method 30 for estimating drilling parameters of a drill rig for drilling a borehole in an earth material. Block 31 calls for drilling the borehole with the drilling rig in operable communication with a drill string having a mud motor and a drill bit. The drill rig is configured to be receptive to adjustable rotational speed of the drill string and adjustable rotational speed of the mud motor.

Block 32 calls for constructing a mathematical model of a system comprising the drill sting, the mud motor, and a geometry of the borehole. The model includes various physical parameters such as physical dimensions, mass distribution, material density, and material stiffness. The stiffness may include elasticity and/or Poisson's Ratio. In one or more embodiments, the geometry may be imported from a computer-aided-design (CAD) software program. Non-limiting embodiments of the CAD software are Solid Works, ProEngineer, AutoCAD and CATIA. The model may be three-dimensional model or a two-dimensional model. It can be appreciated that if a component is disposed at (i.e., in or on) the drill string, then that component may be modeled as part of the drill string.

Block 33 calls for calculating a mud motor lateral excitation force imposed on the drill string by the mud motor for one or more (i.e., a plurality) of combinations of drill string rotational speed and mud motor rotational speed. The mud motor rotational speed may be derived from the drilling fluid flow rate and, accordingly, the mud motor rotational speed may be adjusted by adjusting the drilling fluid flow rate. One source of lateral vibration of the drill string is generally the mud motor of the BHA, which has a mass imbalance due to the off-center path of the rotor. The excitation frequency $f_{exc}$ of the mud motor is represented as:

$$f_{exc}=z*f_{rot}-f_{str}$$

with z representing the lobe configuration of the rotor of the mud motor, $f_{rot}$ representing the rotational frequency of the rotor of the mud motor, and $f_{str}$ representing the rotational frequency of the drill string. Lobe configuration z is generally the number of lobes in the rotor. For the example illustrated in FIG. 2, z equals five because there are five lobes. The minus sign is used because the rotor moves in a direction that is opposite to the direction of rotation of the mud motor output. The absolute value of the lateral excitation force (f) due to the mud motor is dependent of the eccentricity (r) of the mass imbalance (m) and may be represented as:

$$f=m\omega_{exc}^2 r$$

where $\omega_{exc}$ represents the rotational frequency of the mud motor in radians per unit of time.

Block 34 calls for calculating lateral motion of the drill string and a force imposed on the drill string at a plurality of positions along the drill string for the one or more combinations of drill string rotational speed and mud motor rotational speed using the mathematical model (shown in block 22) and the mud motor lateral excitation force (calculated in block 23). A frequency response function of the drill string system is calculated with the mass imbalance of the mud motor as a source of excitation using a software program, which can calculate motion when imposed forces are known, such as BHASYSPro available from Baker Hughes Inc. The frequency response (e.g., the system's vibration response) may be calculated or it can be based on measurements or experience, such as from lookup tables based upon history data from other drilled boreholes. In one or more embodiments for example, the mathematical model is a finite element model. Calculations may include using a finite difference method or a transfer matrix method as known in the art. Beam elements can be used which are nonlinear with respect to the deflection. The degrees of freedom of the nodes representing the structure can be the three translational (e.g. x, y, z) and the three rotational degrees of freedom ($\phi_x$, $\phi_y$, $\phi_z$). Borehole geometry may be imported for example from a caliper measurement performed by the downhole caliper tool and may be sent in real time to the computer processing system 13. Alternatively, the borehole geometry may be imported from a borehole or well plan used for drilling the borehole. The minimum curvature method can be used to model the borehole geometry. This means the geometry is approximated by adjacent circles. In one or more embodiments, a static solution is then calculated where boundary conditions of the system are defined. For example the axial deflection at the top of the drill string (e.g., at the hook) can be set to zero. The static deflection of the Finite-Element-Model of the drill string is calculated under consideration of the borehole survey geometry. The survey geometry can be considered by generating a penalty formulation of the contact between the drill string and the borehole that is a force proportional to the intersection of drill string. The solution is nonlinear and therefore iterative (a Newton like solver may be used) because the wall contacts are nonlinear (separation vs. contact) and there are nonlinear geometric forces due to the nonlinearity of the finite elements. Wall contact forces and intersections are calculated. The mass matrix M and stiffness matrix K are calculated with respect to the static solution. Therefore, the nonlinear geometric forces are linearized. This is equal to the development of the Taylor series of the nonlinear geometric forces. Additionally, a damping matrix C can be considered and calculated. Valid approximations of the damping matrix $\overline{C}$ are Rayleigh damping or structural damping. The equation of motion may be written as $M\ddot{x}+C\dot{x}=f+f_{nl}$ where f is a force matrix or vector representing the dynamic force applied to the drill string, $f_{nl}$ is a non-linear force matrix or vector representing non-linear forces applied to the drill string, and x is a displacement vector. The single dot represents the first derivative with respect to time and the two dots represent the second derivative with respect to time. The equation of motion is solved with respect to the displacement x. The dynamic stiffness matrix S as known in the art is calculated where $S=\omega_{exc}^2M+i\omega_{exc}C+K$ (i is a complex number). From $S*x=f_{exc}$, x can be determined knowing S and $f_{exc}$. Using these equations, bending moments, stresses and strains, lateral forces, and tangential forces, for example, can be calculated at any point of the drill string using the finite elements as is known in the art.

Figure 4:
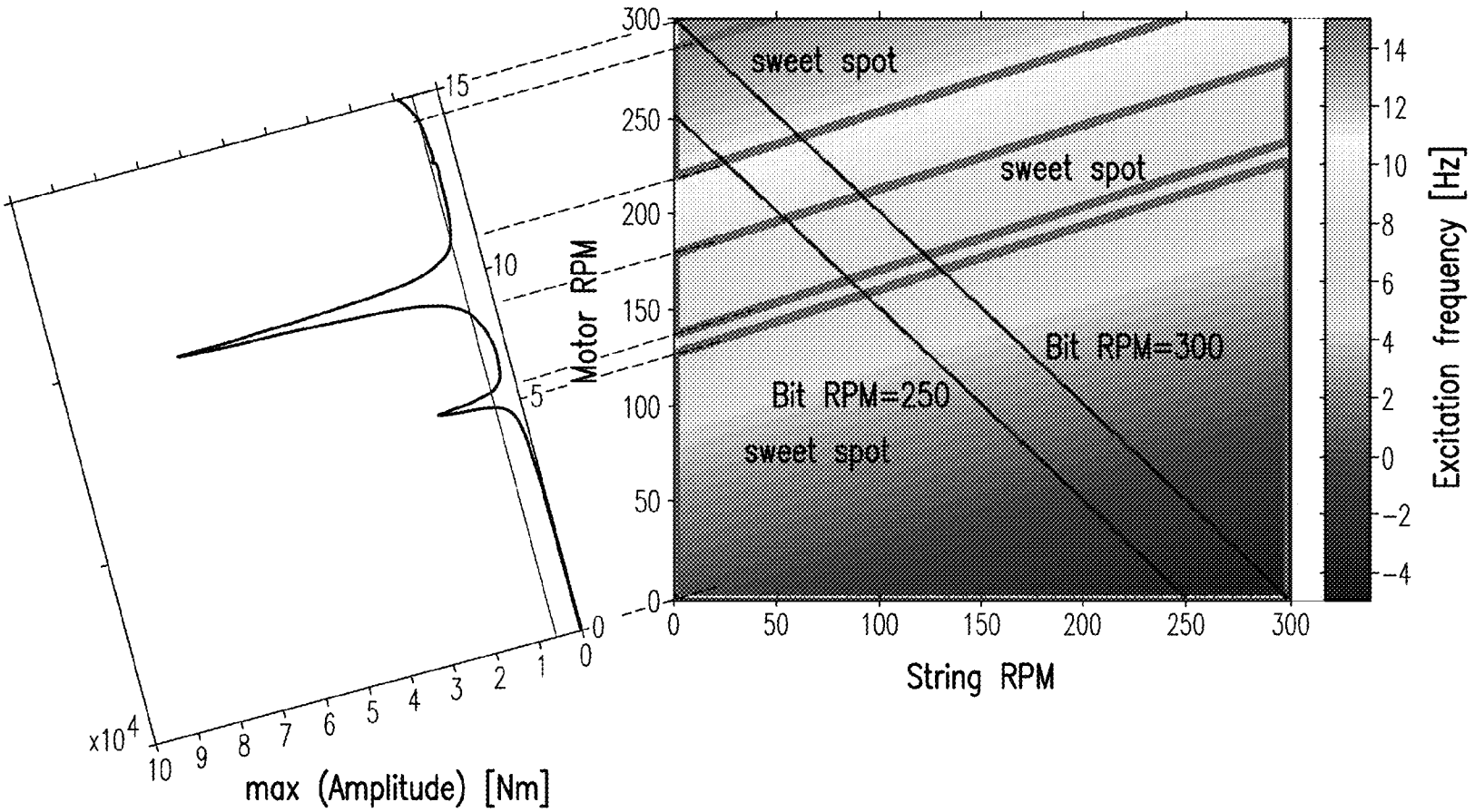
FIG. 4 illustrates a cross-plot of mud motor speed and drill string speed displaying combinations thereof that avoid high lateral drill string vibration levels.

Block 35 calls for selecting a range of combinations of drilling parameters that result in the force imposed upon the drill string being less than a threshold value. The threshold value is generally selected such that drill string and drill string components will not be damaged when subjected to a force caused by a vibration below the threshold value. In one or more embodiments, the threshold value may be a percentage (e.g., 10%) of a peak value of a force imposed on the drill string. Alternatively, the threshold value can be a weighted value of different variables and can, for example, include stresses due to static deformation or can vary depending on the mud motor excitation frequency. An example is illustrated in FIG. 4 where the number of lobes in the mud motor rotor is three (i.e., z=3). FIG. 4 includes a cross-plot of mud motor RPM (revolutions per minute) versus drill string RPM with the resulting excitation frequency (Hz) for each combination of mud motor RPM and drill string RPM. A plot of bending moment (Nm) versus the excitation frequency is also illustrated in FIG. 4. The threshold value is plotted in the bending moment plot and separates critical values from non-critical values of the bending moment or displacement amplitudes. Forces, such as bending moment, that exceed the threshold value are to be avoided. Hence, it is desirable to operate the drill string at those combinations of mud motor RPM and drill string RPM where the resulting excitation frequencies do not cause the drill string to exceed the bending moment threshold (or thresholds of other types of forces). The desirable combinations of mud motor RPM and drill string RPM are referred to as "sweet spot" areas and marked between lines having a positive slope in the right side of FIG. 4.

Figure 5:
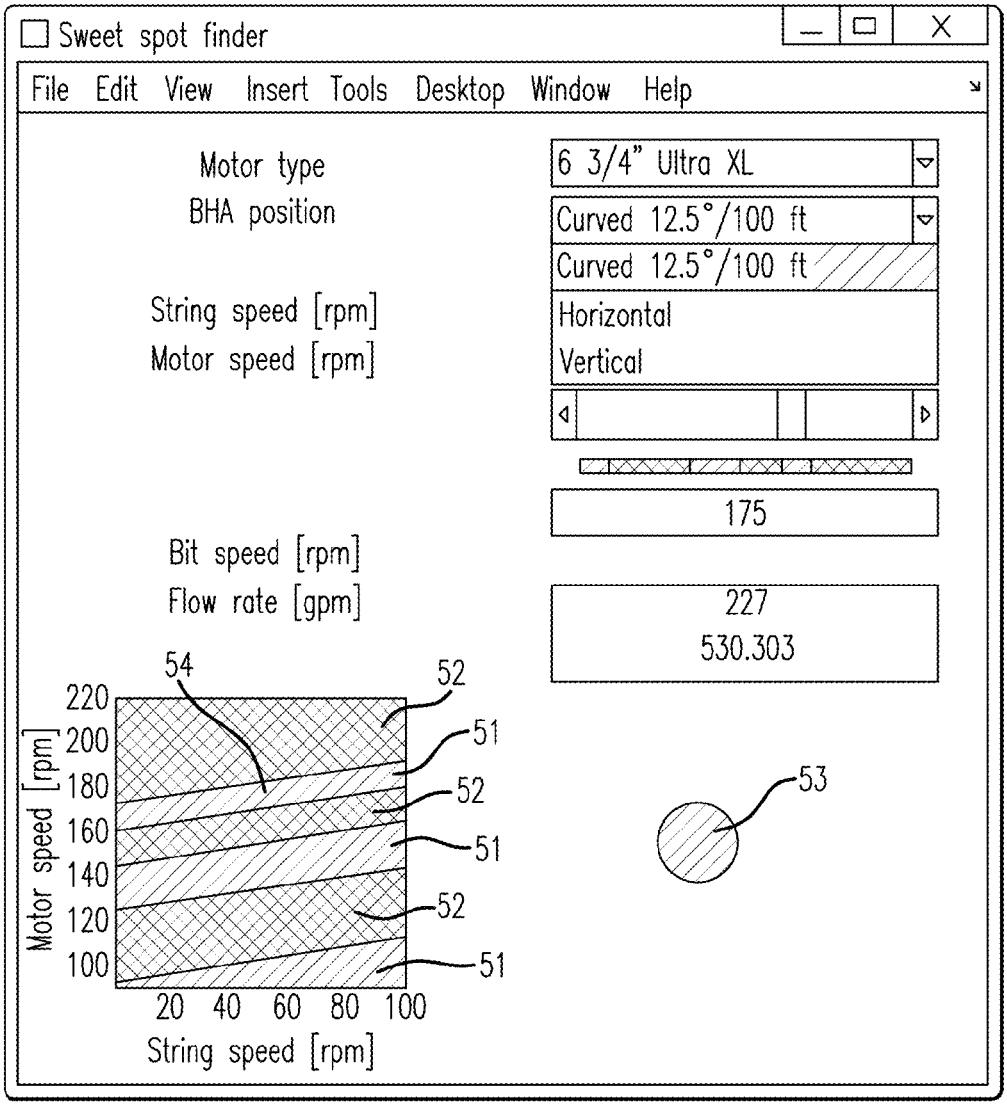
FIG. 5 depicts aspects of a display illustration presenting combinations of mud motor speed and drill string speed that avoid high lateral drill string vibration levels.

Block 36 calls for displaying the range of combinations to a user using a display. One example of a screen display is the right side of FIG. 4 illustrating the sweet spot areas with the resulting excitation frequency values being presented using various shades of color with a color index shown at the extreme right hand side. For example the color at −4 may be dark blue with the colors changing through various shades of blue, green, yellow and finally orange at 14 illustrated at the legend on the right side of FIG. 4. FIG. 5 illustrates another embodiment of a screen display. In the embodiment of FIG.

5, a first color 51 is used to illustrate the sweet spot areas while a second color 52 is used to illustrate those areas that are not sweet spots. An indicator 54 such as an "x" marks the current combination of drill string RPM and mud motor RPM being used to drill the borehole. In addition, an indicator color spot 53 presents a color that corresponds to the region of the actual rotational speeds of the drill string and mud motor. For example, if the first color 51 is green and the second color 52 is red and the drill string and mud motor are being operated in a sweet spot, then the indicator 53 will be green. If the drill string and mud motor are being operated in an area that is not a sweet spot, then the indicator 53 will be red. Other parameters presented to a user in FIG. 5 include the type of mud motor, the position of the BHA, the drill string RPM, the mud motor RPM, the drill bit RPM, and the drilling fluid flow rate.

Figure 6:
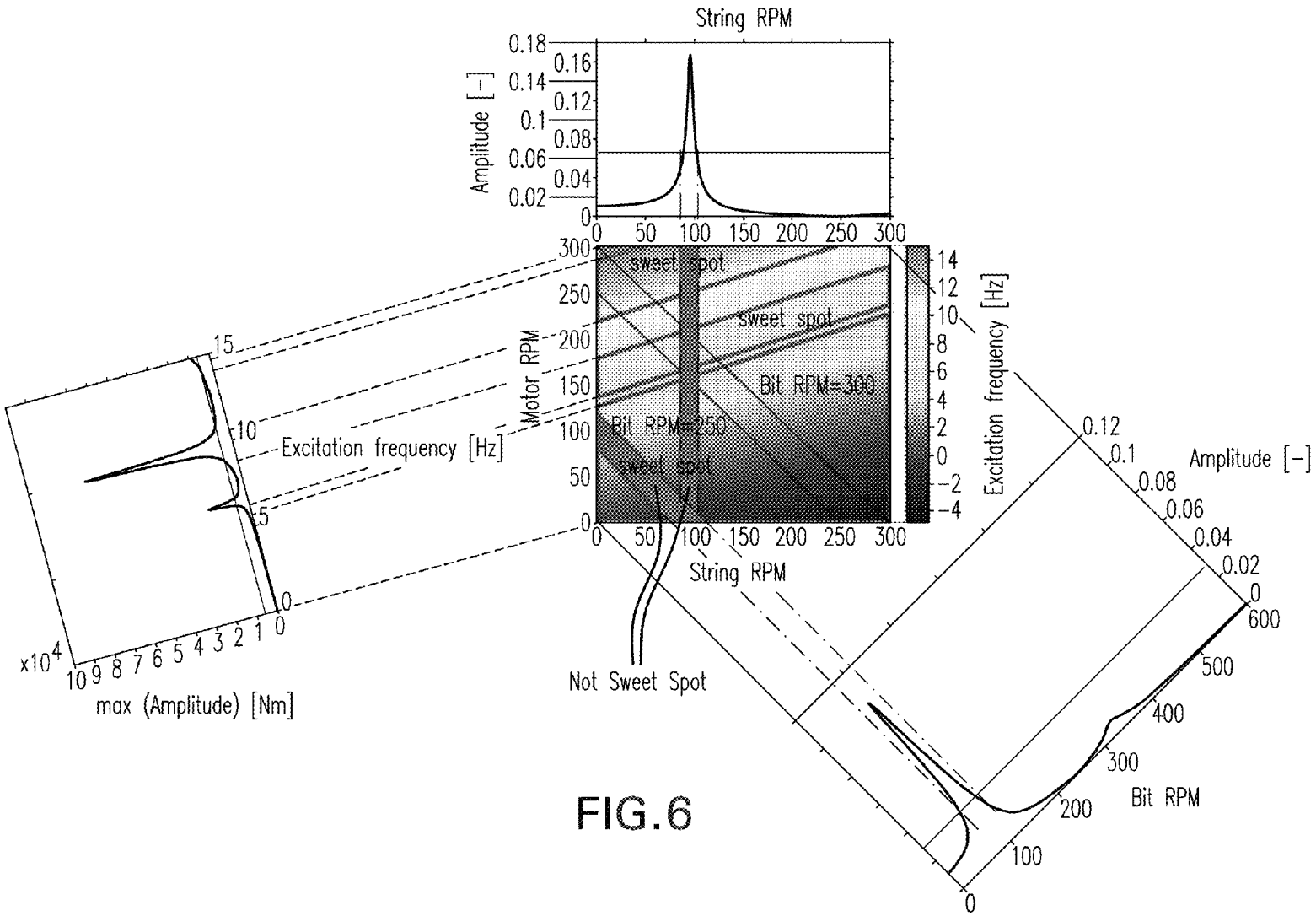
FIG. 6 is a cross-plot of mud motor speed and drill string speed displaying combinations thereof that avoid high lateral drill string vibration levels while considering imbalances below and above the mud motor.

It can be appreciated that the method 30 can also be adapted to account for other rotating mass imbalances or periodic forces. In general, these other mass imbalances or periodic forces result in secondary excitation forces that have magnitudes that are less than the excitation force due to the mud motor. The secondary excitation forces may be above the mud motor and excite at drill string RPM or may be below the mud motor and excite at drill bit RPM. In addition, multiples of RPM values (i.e., harmonics) may be considered if they are significant. Mass imbalances of tools disposed at the drill string may also be accommodated in addition to forces above or below the mud motor due to periodic impacts of a rotating structure such as with the borehole wall. One example of periodic impacts involves the "cam shaft" effect of a straight-bladed stabilizer of a drill string in an over-sized borehole. The stabilizer will make contact periodically as the drill string rotates imposing a periodic force on the drill string. In FIG. 6, the x-axis is equal to drill string RPM which is proportional to the drill string excitation frequency. Again, a frequency response function can be calculated for this kind of excitation which is depicted in the upper part of the figure. A threshold level (horizontal line on each of the three graphs when viewing those graphs in upright position) is defined (e.g. for the bending moment) for this kind of excitation and RPM ranges for the drill string RPM can be defined in which the bending moment exceeds a certain value at a point along the BHA (black dotted vertical lines). These ranges are marked as not being sweet spot areas in the drill string RPM vs. mud motor RPM diagram. These areas have to be avoided with drill string RPM because of high stresses along the drill string or BHA. Bit RPM can also be found in the diagram. The diagonal lines with constant bit RPM can be found by connecting the x-axis and y-axis with the same value of RPM. Mathematically this is described as: $RPM_{bit}=+RPM_{string}+RPM_{motor}$. A frequency response can be calculated with imbalances distributed between the bit and the mud motor which are rotating with bit RPM as depicted in the lower right part of the figure. Again, this leads to areas with a range of the bit RPM which has to be avoided. The borders of these areas are defined by the diagonal dotted lines which are determined by the frequency response function. The acceptable RPM ranges from all excitation sources are combined in one diagram as depicted in FIG. 6. It is noted that all multiples of drill string and bit RPM and sums of these could be used as excitation sources. It can be appreciated that the line depicting the threshold value may not be a horizontal line, but it can be a non-horizontal line, a curved line or a stepped line in non-limiting embodiments. In addition, the threshold line may be a function of frequency or dependent on a type of tool being used.

Further, a superposition of frequency response functions of statistically distributed mass imbalances can be used. These can for example be determined by Monte-Carlo-Simulations. Therefore, a mass (imbalance) is placed at a statistically determined place and eccentricity along the BHA or drill string. A frequency response function corresponding to this imbalance is calculated in the RPM range of interest. This is repeated for different statistically placed masses and leads to different frequency response functions. For example, the maximum along the frequency range of all response functions can be used with a threshold to determine acceptable combinations with regard to vibrations.

It can be appreciated that the drilling parameter selection method provides several advantages. One advantage is that those combinations of drilling parameters that result in imposing forces on the drill string that are less than threshold level forces, which may cause equipment degradation or damage, are readily observable by an operator or user. If the operator observes that the drilling parameters currently being used result in imposing forces on the drill string that exceed the threshold level, then the operator can quickly adjust the drilling parameters into the sweet spot area where the imposed forces are less than the threshold level. Another advantage is that an operator can anticipate what the sweet spot areas of drilling parameter combinations will be based on the present knowledge of the drill string geometry and a plan for drilling the borehole, which will result in knowledge of the anticipated geometry of the borehole. Hence, the operator can have knowledge for avoiding non-sweet spot areas before drilling the borehole. If, for example, a downhole caliper tool provides borehole caliper data in real time, then the sweet spot areas of drilling parameter combinations can be updated in real time using the more accurate borehole geometry obtained from the caliper tool.

In support of the teachings herein, various analysis components may be used, including a digital and/or an analog system. For example, the downhole electronics 24, the computer processing system 13, or the downhole caliper tool 11 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements. The term "couple" relates to a first component being coupled to a second component either directly or indirectly through an intermediate component.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating drilling parameters of a drill rig for drilling a borehole in an earth material, the method comprising:

drilling the borehole with the drilling rig in operable communication with a drill string having a mud motor and a drill bit, the drill rig being receptive to adjustable rotational speed of the drill string and adjustable rotational speed of the mud motor;

constructing a mathematical model of a system comprising the drill string, the mud motor, and a geometry of the borehole using a processor, the model comprising dimensions, mass distribution, material density, and material stiffness;

calculating a mud motor lateral excitation force imposed on the drill string by the mud motor for one or more combinations of drill string rotational speed and mud motor rotational speed using the processor;

calculating, with the processor, lateral motion of the drill string and a value of a force related parameter imposed on the drill string at a plurality of positions along the drill string for the one or more of combinations of drill string rotational speed and mud motor rotational speed using the mathematical model and the mud motor lateral excitation force;

selecting a range of combinations of drill string rotational speed and mud motor rotational speed that result in the value of the force related parameter imposed upon the drill string being less than a threshold value using the processor, wherein the drilling parameters comprise drill string rotational speed and mud motor rotational speed; and displaying the range of combinations to a user using a display.

2. The method according to claim 1, wherein calculating lateral motion of the drill string and a force imposed on the drill string comprises using at least one of weight-on-bit and torque at the drill bit as forces imposed on the drill string.

3. The method according to claim 1, further comprising receiving borehole caliper data obtained by a downhole caliper tool coupled to the drill string using a processor, the borehole caliper data comprising the geometry of the borehole.

4. The method according to claim 1, further comprising receiving the borehole geometry from a borehole plan.

5. The method according to claim 4, wherein the mud motor rotational speed is derived from a drilling fluid flow rate.

6. The method according to claim 1, wherein calculating a mud motor lateral excitation force comprises solving the following equation:

$$\text{mud motor lateral excitation force}=m\omega_{exc}^2 r$$

where m represents mass imbalance of a rotor of the mud motor, $\omega_{exc}=2\pi f_{exc}$ where $f_{exc}$ represents an excitation frequency of the mud motor, and r represents an eccentricity of the rotor of the mud motor.

7. The method according to claim 6, wherein the excitation frequency of the mud motor is calculated by solving the following equation:

$$f_{exc}=zf_{rot}-f_{str}$$

where $f_{exc}$ represents the excitation frequency of the mud motor, $f_{rot}$ represents a rotational frequency of the rotor of the mud motor, z represents a configuration factor of the rotor of the mud motor, and $f_{str}$ represents a rotational frequency of the drill string.

8. The method according to claim 7, wherein the configuration factor comprises a number of lobes configured to rotate in the rotor.

9. The method according to claim 1, wherein the value of the force related parameter imposed on the drill string is the value of one selection from a group consisting of a lateral force, a tangential force, a torque, a bending moment, a stress and a strain.

10. The method according to claim 1, wherein displaying the range of combinations to a user using a display comprises using a first color to indicate combinations of drilling parameters in the range and a second color to indicate combinations of drilling parameters outside of the range.

11. The method according to claim 1, wherein displaying the range of combinations to a user using a display comprises displaying a cross-plot of a first drilling parameter and a second drilling parameter with the calculated value of the force related parameter imposed on the drill string for each combination of the first drilling parameter and the second drilling parameter.

12. The method according to claim 1, wherein calculating the lateral motion of the drill string comprises calculating a lateral displacement at one or more points along the drill string.

13. The method according to claim 1, further comprising calculating a secondary excitation force imposed on the drill string at least one of below and above the mud motor for the drill string rotational speed in the one or more combinations of drill string rotational speed and mud motor rotational speed.

14. The method according to claim 13, wherein the secondary excitation force is due to a mass imbalance.

15. The method according to claim 13, wherein the secondary excitation force is due to a periodic impact of a drill string component.

16. An apparatus for drilling a borehole in an earth material, the apparatus comprising:

a drill string coupled to a drill bit configured to drill the borehole;

a mud motor disposed at the drill string and configured to rotate the drill bit;

a drill rig in operable communication with the drill string and configured to operate the drill string to drill the borehole, the drill rig being receptive to adjustable rotational speed of the drill string and adjustable rotational speed of the mud motor;

a processor configured to:

receive a mathematical model of a system comprising the drill sting, the mud motor, and a geometry of the borehole, the model comprising dimensions, mass distribution, material density, and material stiffness;

calculate a mud motor lateral excitation force imposed on the drill string by the mud motor for one or more of combinations of drill string rotational speed and mud motor rotational speed;

calculate lateral motion of the drill string and a value of a force related parameter imposed on the drill string at a plurality of positions along the drill string for the one or more combinations of drill string rotational speed and mud motor rotational speed using the mathematical model and the mud motor lateral excitation force;

select a range of combinations of drilling parameters that result in the value of the force related parameter imposed upon the drill string being less than a threshold value;

provide the range of combinations to a display;

a display configured to receive the range of combinations from the processor and to display the range of combinations to a user.

17. The apparatus according to claim 16, wherein the processor is further configured to construct the mathematical model.

18. The apparatus according to claim 16, wherein the mud motor comprises a rotor having one or more lobes.

19. The apparatus according to claim 16, further comprising a downhole caliper tool coupled to the drill string and configured to measure the caliper of the borehole to provide the geometry of the borehole.

20. The apparatus according to claim 19, wherein the processor is further configured to receive the geometry of the borehole from the downhole caliper tool.

21. The apparatus according to claim 16, wherein the processor is further configured to receive the geometry of the borehole from a borehole plan.

* * * * *